US007726091B2

(12) United States Patent
Frohlich et al.

(10) Patent No.: US 7,726,091 B2
(45) Date of Patent: Jun. 1, 2010

(54) SUPPORT SHOE FOR CONCRETE PYLONS

(75) Inventors: Klaus Frohlich, Pforzheim (DE); Andreas Hanke, Leichlingen (DE)

(73) Assignee: Halfen GmbH & Co. KG, Langenfeld-Richrath (DE)

( * ) Notice: Subject to any disclaimer, the term of this patent is extended or adjusted under 35 U.S.C. 154(b) by 1599 days.

(21) Appl. No.: 10/904,481

(22) Filed: Nov. 12, 2004

(65) Prior Publication Data

US 2005/0102924 A1 May 19, 2005

(30) Foreign Application Priority Data

Nov. 13, 2003 (EP) ..... 03025933

(51) Int. Cl.
*E04C 5/20* (2006.01)
*E04C 5/12* (2006.01)
*E04C 3/34* (2006.01)

(52) U.S. Cl. ..... 52/707; 52/699; 52/170; 52/295; 248/346.5

(58) Field of Classification Search ..... 52/707, 52/699, 698, 295–298, 689, 170, 741.15; 405/251, 252, 255, 230; 248/346.5
See application file for complete search history.

(56) References Cited

U.S. PATENT DOCUMENTS 2,110,683 A * 3/1938 Scholer ..... 156/206
2,280,220 A * 4/1942 Crosby ..... 52/126.6
3,324,524 A * 6/1967 Perron et al. ..... 432/259
3,572,223 A * 3/1971 Vierreger ..... 52/296
3,693,310 A * 9/1972 Middleton ..... 52/685
3,712,014 A * 1/1973 Waerner ..... 52/707
3,934,528 A * 1/1976 Horton et al. ..... 114/296
4,050,211 A 9/1977 Wahman ..... 52/726
4,169,424 A * 10/1979 Newby et al. ..... 114/265
4,281,613 A * 8/1981 Ray et al. ..... 114/230.23
4,345,734 A * 8/1982 Studinger ..... 248/669
4,578,917 A * 4/1986 Brobst ..... 52/478
4,684,097 A * 8/1987 Cox ..... 248/354.3
4,750,306 A * 6/1988 Granieri ..... 52/251
4,781,006 A * 11/1988 Haynes ..... 52/583.1
4,783,935 A * 11/1988 Creager ..... 52/98
4,831,803 A * 5/1989 Leonardis ..... 52/323
4,901,490 A * 2/1990 Zinniel et al. ..... 52/263
5,205,673 A * 4/1993 Bolin et al. ..... 405/230
5,224,311 A * 7/1993 Pearce ..... 52/169.9
5,609,005 A * 3/1997 Schierloh et al. ..... 52/699
2004/0079044 A1 * 4/2004 Troth et al. ..... 52/696

FOREIGN PATENT DOCUMENTS

DE 195 14 685 11/1995
EP 1 057 950 12/2000

* cited by examiner

*Primary Examiner*—Phi Dieu Tran A
(74) *Attorney, Agent, or Firm*—Gudrun E. Huckett

(57) ABSTRACT

A support shoe for a concrete pillar has a base plate and two lateral plates arranged at lateral edges of the base plate and projecting upwardly at a right angle from the base plate. At least one reinforcement bar is connected to the support shoe for introducing forces into the concrete pillar. The two lateral edges and thus also the lateral plates connected thereto are arranged at an acute angle relative to one another, wherein the two lateral plates are formed as separate components connected to the base plate.

15 Claims, 2 Drawing Sheets

SUPPORT SHOE FOR CONCRETE PYLONS

BACKGROUND OF THE INVENTION

The invention relates to a support shoe for concrete supports or pylons, concrete pillars or the like. The support shoe comprises a base plate and two lateral plates arranged at lateral edges of the base plate and projecting approximately at a right angle upwardly from the base plate and comprising at least one reinforcement bar (rebar) that is connected to the support shoe for introducing forces into the concrete pillar.

Such support shoes are used, for example, in high-rise construction for connecting by screwing pre-manufactured concrete parts. For example, appropriately pre-manufactured concrete pillars have in the area of their end faces several support shoes that are fixedly embedded in the concrete part together with reinforcement bars secured on lateral plates of the support shoe. A base plate and lateral plates that are arranged on lateral edges of the base plate at a right angle relative to the base plate delimit a free space that enables access to a screw connection. For this purpose, the base plate has a screw hole. The base plate with the screw hole is positioned in the plane of the end face of the concrete pillar. The concrete pillar or support can be connected to a ceiling or a foundation that has bolts embedded in the concrete. Also, it is possible to connect by means of a screw that is pushed through the screw hole two base plates adjoining one another and arranged at the end faces of two concrete pillars that are to be connected to one another via their end faces.

In order to provide high strength, the support shoes must be embedded securely in the concrete part. For realizing the screw connection, a good accessibility of the free space between the lateral plates and the base plate is required; at the same time, a compensation of dimensional tolerances must also be enabled. Moreover, it is desirable to be able to manufacture the support shoe with simple means.

DE 195 14 685 C2 discloses a support shoe that is referred to as a pile shoe wherein the base plate has a substantially square foot print. Two lateral plates are formed as a monolithic part by folding a sheet metal at a right angle wherein the folded sheet metal portion projects at a right angle upwardly from the base plate and is welded to lateral edges of the square base plate that extend toward one another. Two reinforcement bars are welded to the facing inner surfaces of the angled lateral sheet metal and extend perpendicularly to the base plate. The two legs of the L-shaped angled lateral plate extend approximately across half of the two lateral edges of the base plate wherein the two reinforcement bars are arranged in the area of the exposed vertical edges of the L-profile and are therefore arranged approximately centrally relative to the lateral edges of the base plate. Tolerances resulting from folding of the lateral sheet metal can lead to difficulties when welding them to the base plate. A reliable welding of the reinforcement bars to the two legs is made more difficult because the accessibility of the welding seams positioned in the direction of the fold line is impaired by the lateral plates. The reinforcement bars that are positioned at the inner side of the L-profile are positioned close to the screw hole in the base plate. The accessibility of the screw connection as well as a positional tolerance compensation of two adjoining screw holes relative to one another are made more difficult.

SUMMARY OF THE INVENTION

It is an object of the invention to further develop the support shoe of the aforementioned kind such that with a simplified manufacturing expenditure a simple assembly of the concrete parts to be connected to one another is enabled.

In accordance with the present invention, this object is solved by a support shoe wherein the two lateral edges and thus also the lateral plates connected thereto are arranged at an acute angle relative to one another, wherein the two lateral plates are configured as separate components connected to the base plate.

For this purpose, an appropriate support shoe is proposed where the two lateral edges of the base plate with the lateral plates arranged thereat are arranged at an acute angle to one another, wherein the two lateral plates are configured as components that are separate from one another and are connected to the base plate. An expedient angle was found to be an acute angle in the range between including 30 degrees and including 75 degrees, and in particular of approximately 45 degrees. The two-part configuration of the lateral plates enables a precise manufacture of these plates from simple sheet material with simple means. The tolerance-incurring process of folding is eliminated. The position-precise welding to the base plate is significantly simplified.

With an advantageous configuration of the base plate in the form of an irregular polygon the variability of the arrangement relative to the cross-sectional surface of the concrete pillar is improved.

Particularly in the case of a configuration of the arrangement where the two lateral plates in the area of the rear vertical edges facing one another have a spacing relative to one another, an attachment of the reinforcement bars on the two lateral plates is significantly simplified. It is possible to access through the space between the two lateral plates from both sides the reinforcement bars and to generate a welding seam for securing the reinforcement bars without spatial restrictions. A reliable securing of the reinforcement bars that can be monitored without any restriction with regard to quality results either by direct welding of the reinforcement bars to the lateral plates or by welding a threaded sleeve thereto into which a matching reinforcement bar with a threaded head can be screwed.

The acute arrangement of the two lateral plates relative to one another enables a universal application of the support shoe not only in the area of the pillar edges but also for a central arrangement in the area of a lateral building component surface.

In an expedient further embodiment, a rear transverse edge is formed between the rear end of the two lateral edges of the base plate in the area of the facing vertical edges of the lateral plates. The extension of the base plate is essentially limited by the rear vertical edge of the lateral plates. Correspondingly configured support shoes can also be employed in comparatively small concrete cross-sections without the base plates overlapping one another, respectively.

For a simple fixation of a support shoe during embedding in a concrete part, at the rear transverse edge of the base plate a fixation element is provided, in particular in the form of a reinforcement bar that is bent upwardly out of the plane of the base plate. The arrangement at the rear transverse edge leads to the fixation element being spaced sufficiently far away from the reinforcement bars at the lateral plates. The position of the lateral reinforcement bars can be selected freely without causing overlap or an undesirable minimal spacing.

In an advantageous further embodiment, between the two lateral edges in the leading area of the base plate two corner edges that are positioned at an angle to one another and in particular at a right angle to one another are provided. In this way, a surface-flush arrangement in the area of the component corners is enabled. In this connection, a configuration may be expedient where between the two corner edges a front edge extends. In this way, an overall polygonal footprint of the base plate results that enables a universal positioning at building component corners or in the area of the lateral building component surfaces.

In an expedient embodiment, the corner edges are arranged in the area of the vertical edges of the lateral plates that are spaced from one another. For a flush contacting of the corner edges on corner surfaces of a concrete support, the lateral plates are extended to the corner surfaces of the concrete support. Additional shuttering measures during concrete pouring are not required.

In an advantageous embodiment, the lateral plate has a longitudinal slot in which the reinforcement bar is secured, respectively. In this way, the reinforcement bar is positioned at least approximately within the sheet plane; this leads to a central force introduction that increases the carrying capacity. In this connection, the two reinforcement bars have a comparatively large distance relative to one another. This contributes, particularly in combination with shortened lateral plates, to an improved accessibility of the screw connection as well as a simplified positional tolerance compensation of two base plates resting against one another. A reliable and easily controllable welding action is possible from the inner side as well as the outer side of the respective lateral plate. Welding of the reinforcement bar or of an appropriate threaded sleeve for receiving a reinforcement bar can be realized without spatial restriction of a quality control.

In an advantageous variant, the edges of the two lateral plates that are spaced from the base plate are connected in the area of their upper ends to a transverse plate wherein one or several reinforcement bars are secured to the transverse plate. By means of the transverse plate, the reinforcement bars can be secured in close proximity to the hole axis of the screw hole. In this way, a correspondingly beneficial course of the force within the concrete part is realized without the accessibility of the screw connection being limited by the reinforcement bars.

A variant may also be advantageous in which the reinforcement bars are welded to the respective outer side of the lateral plates. This enables easy accessibility of the welding seams.

Optionally, an embodiment may be expedient where the vertical edges of the lateral plates that are spaced apart from one another extend at a slant to the rear away from the base plate. This provides a wider lower area of the lateral plates that enables a sturdily sized welding connection to the base plate. As a result of the vertical edge extending at a slant to the rear, the lateral plates become narrower with increasing spacing from the base plate; this increases the movement space of a screwing tool to be used.

BRIEF DESCRIPTION OF THE DRAWINGS

Embodiments of the invention will be explained in more detail in the following with the aid of the drawing.

DESCRIPTION OF PREFERRED EMBODIMENTS

Figure 1:
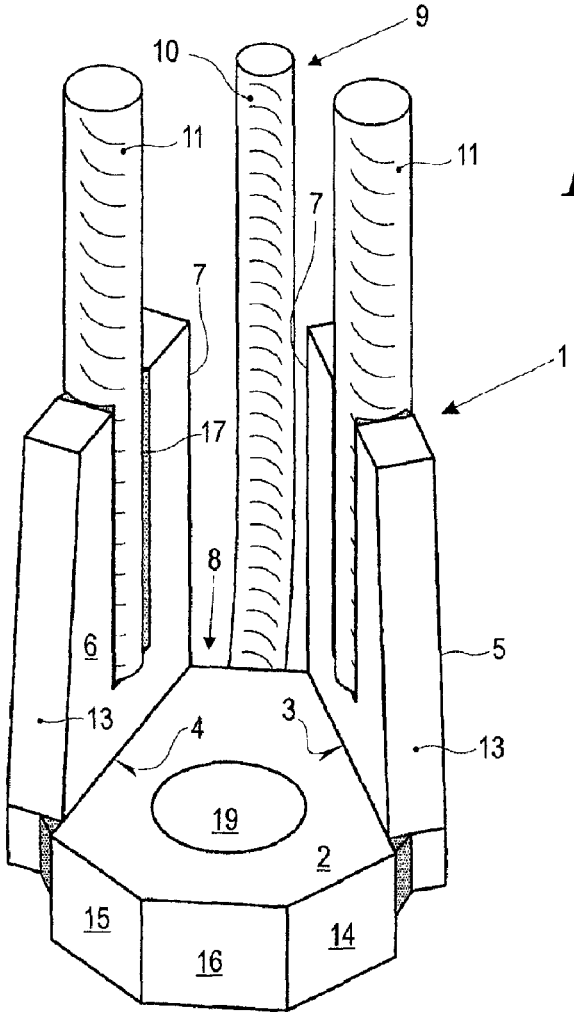
FIG. 1 shows in a perspective view a support shoe with a base plate and separately formed lateral plates positioned at an acute angle relative to one another that receive a reinforcement bar in longitudinal slots, respectively.

FIG. 1 shows in a perspective front view a support shoe 1 comprising a base plate 2, two lateral plates 5, 6, as well as reinforcement bars (rebar) 10, 11. In the illustrated embodiment, the base plate 2 has a polygonal footprint formed by a front edge 16, two corner edges 14, 15, two lateral edges 3, 4 adjoining the corner edges, and a rear transverse edge 8. The base plate 2, relative to its extension in the transverse direction, is provided with a centrally arranged opening 19 for receiving a fastening means.

The two lateral plates 5, 6 extend at a right angle to the base plate 2 and are welded to the two lateral edges 3, 4 of the base plate 2. The two lateral plates 5, 6 have each a longitudinal slot 17 extending in the vertical direction and receiving a reinforcement bar 11, respectively. In the illustrated embodiment, the reinforcement bars 11 are secured by welding in the longitudinal slots 17 so that they extend in the plane of the lateral plates 5, 6. The reinforcement bar 10 is welded to the rear transverse edge 8 wherein the reinforcement bar 10 extends initially in the plane of the base plate 2 from the rear transverse edge 8 and is then bent upwardly so that it is parallel to the two lateral reinforcement bars 11, i.e., approximately perpendicular to the plane of the base plate 2. In this connection, the reinforcement bar 10 forms a fixation element 9.

The two lateral plates 5, 6 have rear and front vertical edges 7, 13 extending in the vertical direction, respectively, wherein the two rear vertical edges 7 have a shorter distance from one another than the front vertical edges 13. The rear transverse edge 8 of the base plate 2 extends between the two facing vertical edges 7 of the two lateral plates 5, 6.

Figure 2:
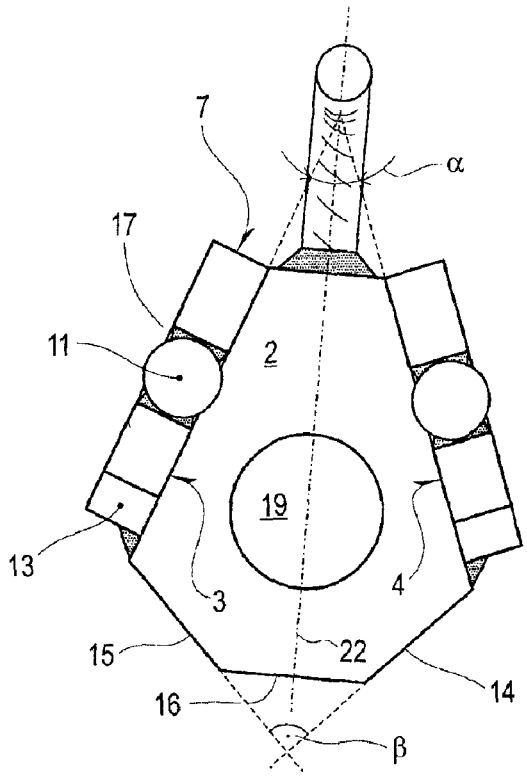
FIG. 2 shows in plan view of the arrangement according to FIG. 1 with details of the footprint configuration of the base plat.

FIG. 2 is a plan view of the arrangement according to FIG. 1 showing the two lateral edges 3, 4 of the base plate 2 positioned at an acute angle $\alpha$ to one another that, in the illustrated embodiment, the angle is approximately 45 degrees. The angle $\alpha$ can also be greater or smaller, as needed, wherein the angular range is expediently between inclusive 30 degrees and inclusive 75 degrees.

Between the two lateral edges 3, 4 of the base plate 2, the two corner edges 14, 15 extend in the area of the spaced apart vertical edges 13 of the lateral plates 5, 6 and are positioned at an angle $\beta$ to one another. The angle $\beta$ in the illustrated embodiment is 90 degrees. The two corner edges 14, 15 are connected to one another by the front edge 16. The support shoe 1 is configured symmetrically relative to a center line 22.

The plan view according to FIG. 2 shows the front vertical edge 13 of the two lateral plates 5, 6 as a surface; accordingly, the front vertical edges 13 extends from the base plate 2 at a slant to the rear in the direction of the rear vertical edges 7.

Figure 3:
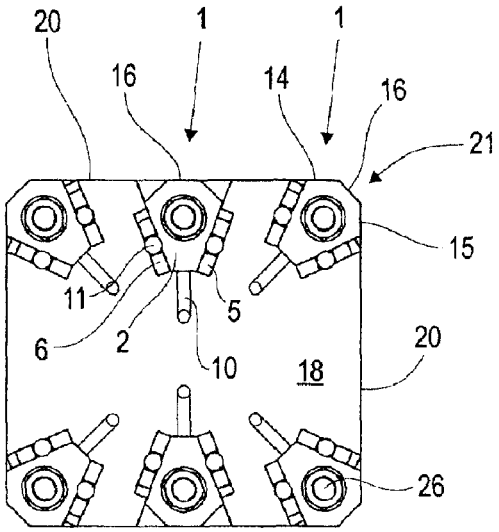
FIG. 3 shows in a schematic illustration a cross-section of a concrete pillar with a total of six support shoes according to FIGS. 1 and 2.

FIG. 3 shows in a schematic cross-section illustration a concrete pillar 18 in which, for example, a total of six support shoes 1 are arranged. Four of the support shoes 1 are arranged in the area of the edges 21 of the concrete pillar, respectively, and are rotated about 45 degrees relative to the lateral surfaces 20 of the concrete pillar 18 such that the corner edges 14, 15 of the base plate 2 are positioned within the lateral surfaces 20. The front edge 16 is positioned so as to overlap the broken edge 21 of the concrete pillar 18. Two additional support shoes 1 are positioned centrally between the pillar edges 21, wherein their front edges 16 are positioned flush with the lateral pillar surfaces 20. In this connection, the illustrated support shoes 1 are configured in accordance with the embodiment of FIGS. 1 and 2.

Figure 4:
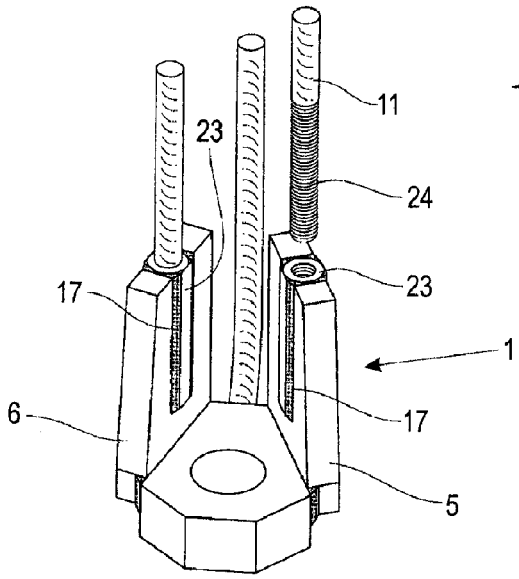
FIG. 4 illustrates a variant of the arrangement according to FIG. 1 with reinforcement bars that can be screwed into the lateral plates.

FIG. 4 shows in a perspective front view a variant of the arrangement of FIG. 1 wherein a threaded sleeve 23 is welded into the longitudinal slots 17 of the two lateral plates 5, 6, respectively. The two threaded sleeves 23 have an inner thread into which a threaded section 24 of a matching reinforcement bar 11 can be threaded. With regard to other features and reference numerals, the illustrated embodiment corresponds to that of FIG. 1.

Figure 5:
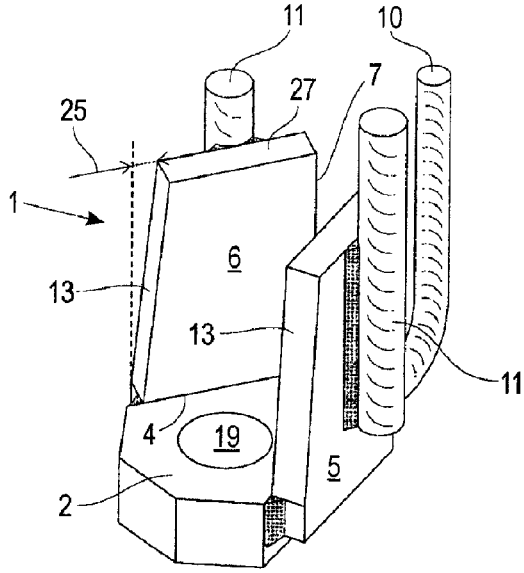
FIG. 5 shows a further variant of the arrangements according to FIGS. 1 and 4 with reinforcement bars that are secured by welding to the outer side of the lateral plates.

A further embodiment of the arrangement of FIGS. 1 and 4 is shown in the perspective illustration of FIG. 5. The two reinforcement bars 11 are welded externally to the outer surfaces of the two lateral plates 5, 6 that face away from one another. In the illustrated perspective view it is clearly shown that the front vertical edge 13 extends away from the lateral edge 4 in the direction toward an upper edge 27 wherein the course of the edge, as indicated by the arrow 25, has a slant component to the rear in the direction toward the rear vertical edge 7. In regard to this and the other features, the illustrated embodiment corresponds to that of FIGS. 1 and 4.

Figure 6:
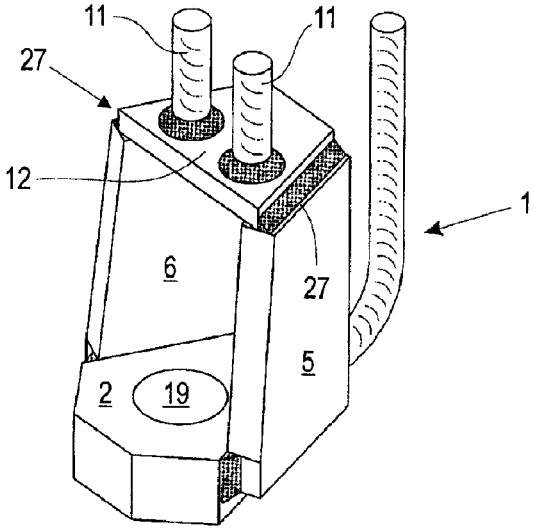
FIG. 6 is an embodiment of the invention with a transverse plate connected to the upper edges of the two lateral plates and with reinforcement bars welded onto the transverse plates.

FIG. 6 shows yet another embodiment in which the two lateral plates 5, 6 are welded with their upper edges 27 facing away from the base plate 2 to a transverse plate 12. The two reinforcement bars 11 are butt-welded onto the transverse plate 12. A different number of reinforcement bars 11 can be expedient in this and the other illustrated embodiments. In particular, it is expedient in the embodiment according to FIG. 6 to arrange one or several reinforcement bars 11 as least approximately co-axially to the screw hole 19.

While specific embodiments of the invention have been shown and described in detail to illustrate the inventive principles, it will be understood that the invention may be embodied otherwise without departing from such principles.

What is claimed is:

1. A support shoe for concrete pillars, the support shoe comprising:

a base plate having lateral edges;

two lateral plates arranged at the lateral edges of the base plate so as to project approximately at a right angle upwardly from the base plate without projecting downwardly past the base plate;

at least one rebar that is connected to the support shoe and is adapted to introduce forces into a concrete pillar;

wherein the two lateral edges are arranged at an acute angle relative to one another and the lateral plates are arranged at an acute angle to one another;

wherein the two lateral plates are separate sheet metal components welded to the lateral edges of the base plate;

wherein the two lateral plates each have a rear vertical edge, wherein the rear vertical edges face one another and have a spacing relative to one another;

wherein the base plate has a rear transverse edge extending between rear ends of the lateral edges in the area of the vertical edges of the lateral plates;

a fixation element provided on the rear transverse edge, wherein the fixation element is a rebar that is bent upwardly out of a plane of the base plate.

2. A support shoe for concrete pillars, the support shoe comprising:

a base plate having lateral edges;

two lateral plates arranged at the lateral edges of the base plate so as to project approximately at a right angle upwardly from the base plate;

at least one rebar that is connected to the support shoe and is adapted to introduce forces into a concrete pillar;

wherein the two lateral edges are arranged at an acute angle relative to one another and the lateral plates are arranged at an acute angle to one another;

wherein the two lateral plates are separate sheet metal components welded to the lateral edges of the base plate;

wherein the base plate has a rear transverse edge extending between rear ends of the lateral edges in the area of vertical edges of the lateral plates;

a fixation element provided on the rear transverse edge, wherein the fixation element is a rebar that is bent upwardly out of a plane of the base plate.

3. The support shoe according to claim 2, wherein the base plate has a shape of an irregular polygon.

4. The support shoe according to claim 2, wherein the base plate has a front end and two corner edges located at the front end of the base plate, wherein the two corner edges are positioned at an angle to one another.

5. The support shoe according to claim 2, wherein the two corner edges are positioned at a right angle to one another.

6. The support shoe according to claim 5, wherein the base plate has a front edge extending between the two corner edges.

7. The support shoe according to claim 5, wherein the two lateral plates each have a front vertical edge and the front vertical edges are spaced apart from one another, wherein the two corner edges adjoin the front vertical edges of the lateral plates.

8. The support shoe according to claim 7, wherein the front vertical edges extend from the base plate at a slant in a direction toward the rear of the base plate.

9. The support shoe according to claim 2, wherein the at least one rebar is welded to the support shoe.

10. The support shoe according to claim 2, wherein the at least one rebar is connected by screwing to the support shoe.

11. The support shoe according to claim 2, wherein at least one of the two lateral plates has a longitudinal slot in which the at least one rebar is secured.

12. The support shoe according to claim 2, further comprising a transverse plate connecting upper ends of the two lateral plates, wherein the at least one rebar is secured to the transverse plate.

13. The support shoe according to claim 2, wherein the at least one rebar is welded to an outer side of the two lateral plates, respectively.

14. The support shoe according to claim 2, wherein the acute angle between the two lateral edges of the base plate is in the range between inclusive 30° and 75°.

15. The support shoe according to claim 14, wherein the acute angle is approximately 45°.

* * * * *